US005505002A

United States Patent [19]

Falco

[11] Patent Number: 5,505,002

[45] Date of Patent: Apr. 9, 1996

[54] VERSATILE NECKTIE TYING AID GAUGE

[76] Inventor: David Falco, 1279 Vicente Dr. #202, Sunnyvale, Calif. 94086

[21] Appl. No.: 405,283

[22] Filed: Mar. 16, 1995

[51] Int. Cl.[6] ..... G01B 3/00; A41H 1/00

[52] U.S. Cl. ..... 33/501; 33/613; 33/679.1; 2/144

[58] Field of Search ..... 33/2 R, 17 R, 33/17 A, 483, 494, 501, 512, 562, 563, 613, 679.1, 732; 2/144, 145, 146, 155, 156; 289/1.5, 17

[56] References Cited

U.S. PATENT DOCUMENTS

| | | | |
|---|---|---|---|
| 2,148,154 | 2/1939 | Garfinkle | 2/146 |
| 2,499,260 | 2/1950 | Rhein | 2/146 |
| 2,739,313 | 3/1956 | Burton | 2/146 |
| 2,994,886 | 8/1961 | Sharp | 2/146 |
| 3,025,528 | 3/1962 | Minter | 2/144 |
| 3,271,780 | 9/1966 | De Jean | 2/146 |
| 3,305,933 | 2/1967 | Munday, Jr. | 33/2 R |
| 3,321,773 | 5/1967 | Orciuch | 2/146 |
| 3,335,426 | 8/1967 | Light | 2/146 |
| 3,490,073 | 1/1970 | Webster | 2/146 |
| 3,571,935 | 3/1971 | Van Wye | 33/501 |
| 3,747,220 | 7/1973 | Weisnicht | 33/501 |
| 3,797,044 | 3/1974 | Chow | 2/146 |
| 3,946,444 | 3/1976 | Parrilla | 2/144 |
| 4,059,906 | 11/1977 | Kurtz | 33/501 |
| 4,564,958 | 1/1986 | Woodward | 2/150 |
| 4,682,419 | 7/1987 | Lynch | 33/613 |
| 4,696,064 | 9/1987 | Morwood | 2/144 |
| 4,845,857 | 7/1989 | Klosterman | 33/613 |
| 5,003,636 | 4/1991 | Marostica | 2/145 |
| 5,088,118 | 2/1992 | Whiteley | 2/144 |
| 5,105,553 | 4/1992 | Weston | 33/613 |
| 5,326,004 | 7/1994 | Dailey, Jr. | 2/144 |

FOREIGN PATENT DOCUMENTS 164214 3/1949 Austria .

*Primary Examiner*—William A. Cuchlinski, Jr.
*Assistant Examiner*—G. Bradley Bennett

[57] ABSTRACT

A versatile necktie tying aid gauge (20) comprising an elongated member with indicia thereon indicating the length of tie contained in a wide variety of tie knots. The gauge (20) determines a final pinch point (90) by adding the length of tie knot to an initial pinch point (86)—determined by the length of tie measured from the end of the wide end of the tie (85), that is equal to the distance between the wearer's desired ending point for the wide end of the tie (88) to a point adjacent the wearer's collar button (87). The wide end of the tie (82) is crossed over the narrow end of the tie (84) at the final pinch point (90), the knot (92) is tied and slipped up to the neckline, and the end of the wide end of the tie (85) is at the desired end point for the wide end of the tie (88).

21 Claims, 10 Drawing Sheets

VERSATILE NECKTIE TYING AID GAUGE

BACKGROUND—FIELD OF INVENTION

This invention relates to neckties, particularly to a device and method for tying a necktie to a desired length.

BACKGROUND—DESCRIPTION OF PRIOR ART

A necktie has been a part of a man's wardrobe for decades. Properly tying the necktie so that it hangs to the desired length has been a problem for equally as long, but especially nowadays when many men desire that the wide (front) end of their ties extends to or just below their beltline, regardless of whether the two ends have equal lengths. There have been many attempts to devise an apparatus or method capable of easily providing a solution to this problem. A large number of patents exist in this area however to my knowledge none of these devices in these patents has achieved commercial success. This indicates that this is a difficult problem to solve satisfactorily and that it still exists.

The prior art in the field falls into the following five broad categories which have the following respective disadvantages:

(1) Specially manufactured ties have mechanisms built directly into the ties at manufacturing time to knot the tie so it comes out to the desired length.

Disadvantage: These ties require a more complicated manufacturing process to incorporate the special mechanisms into the tie.

(2) Rack-type devices mount on a wall or vertical surface.

Disadvantages:

(a) These devices must be mounted on a vertical surface or wall.

(b) These devices are complicated and take up space.

(c) The devices tend to require neck size measurements.

(3) Markers are put on the wide end of the tie to establish the exact point the marked wide end of the tie is to cross over the narrow end of the tie.

Disadvantages:

(a) A marker attached to the tie may fall off during the tying process, during wear, or during cleaning.

(b) The wearer must experiment to determine where to attach the marker to the tie.

(c) A marker must be attached to each tie in the wearer's collection.

(d) A marker must be moved, or a new marker added if the wearer desires to wear the tie slightly longer or slightly shorter, e.g., 5 centimeters (two inches) below the beltline instead of 2.5 centimeters (one inch) below the beltline. The determination of a marker placement is found through an experimentation process of tying the tie and observing the result-this process is repeated until the desired result is achieved.

(e) A marker must be moved, or a new marker added if the wearer desires to tie a different type of knot, e.g., a four-in-hand instead of a Windsor. The determination of a marker placement is found through the above experimentation process.

(f) A marker would have to be moved, or a new marker added if the wearer decides to cinch the knot tighter or looser. The determination of a marker placement is found through the above experimentation process.

(g) A marker would have to be moved, or a new marker added for different individuals, e.g., individuals in the same household having different torso lengths or different torso girths. The determination of a marker placement is found through the above experimentation process.

(4) Markers are attached to ties to position the tie about the wearer's neck in a consistent fashion prior to tying.

Disadvantages:

(a) This method does not provide a consistent tying result—there is nothing to indicate where the wide end of the tie should cross over the narrow end of the tie (b) This method has all the disadvantages listed in (3) above (5) Positioning devices are used to position the tie about the wearer's neck in a consistent fashion prior to tying.

Disadvantages:

(a) These devices do not provide a consistent tying result—there is nothing to indicate where the wide end of the tie should cross over the narrow end of the tie.

(b) The wearer must experiment to determine the device setting. The determination of a device setting is found through the above experimentation process.

(c) Some of these devices require the determination of a new setting for each tie in the wearer's collection that has a different thickness or a different length—while the rest of these devices require the determination of a new setting for each tie in the wearer's collection that has a different thickness.

The determination of a device setting is found through the above experimentation process.

(d) These devices require the determination of a new setting if the wearer desires to tie a different type of knot, e.g., a four-in-hand instead of a Windsor. The determination of a device setting is found through the above experimentation process.

(e) These devices require the determination of a new setting if the wearer desires to wear the tie slightly longer or slightly shorter, e.g., 5 centimeters (two inches) below the beltline instead of 2.5 centimeters (one inch) below the beltline. The determination of a device setting is found through the above experimentation process.

(f) These devices require determination of a new setting if the wearer decides to cinch the knot tighter or looser. The determination of a device setting is found through the above experimentation process.

(g) These devices require the determination of a new setting for different individuals, e.g., individuals in the same household having different torso lengths or different torso girths. The determination of a device setting is found through the above experimentation process.

Note that many prior-art devices have as a goal that the wide end of the tie be the same length as the narrow end of the tie upon completion of tying. This is incompatible with the goal of having the wide end of the tie come out to a desired length.

Note also that many of the prior-art devices have as a goal that the tie be positioned about the wearer's neck in a consistent fashion prior to the tie being tied, but without regard to where the wide end of the tie should cross over the narrow end of the tie upon tying of the knot. It is unlikely that the same user, upon consecutive tyings of a tie, let alone tyings of a tie on different days, would cross the same point on the wide end of the tie precisely on top of the narrow end of the tie. This results in inconsistent knot tying, causing inconsistent tie length results.

Illustrative patents include U.S. Pat. No. 3,747,220 to Weisnicht (1973), U.S. Pat. No. 4,059,906 to Kurtz (1977), U.S. Pat. No. 4,845,857 to Klosterman (1989), U.S. Pat. No. 5,088,118 to Whiteley (1992), and U.S. Pat. No. 5,326,004 to Daily, Jr. (1994).

Weisnicht describes a rather complex rack with the purpose of allowing a person to tie a tie so that the wide end of the tie is a predetermined distance below the narrow end of the tie. The reference point is the narrow end of the tie rather than the relation of the wide end to the beltline. The measuring process requires several steps and knowledge of the neck size of the wearer.

Kurtz describes a slide-rule like device with the purpose of defining the relationship between the wide and narrow ends of the tie. After experimentation to calibrate the device, the user must first consult a table indexing a number of reference factors, and then align the tie with a color-coded portion of the device. Then the tie may be tied. Note the multiple steps required and the relatively complex set of determinations to be made.

Klosterman describes a device that hooks onto the belt and against which the user may rest the wide end of the tie before tying. It requires substantial experimentation to determine the proper reference point. Additionally, it does not provide a crossing point for the wide and narrow ends of the tie, a factor essential in obtaining a consistently tied tie.

Whitely describes a set of temporary and permanent tie markers for use in tying the tie. Note that the temporary markers are used in the trial-and-error process of determining the proper placement of the permanent marker.

Daily, Jr. describes a device, attachable to a belt loop, containing a slidable portion with a locating dot, to which is approximated the narrow end of the tie. The locating dot location is set through experimentation. If any one of a number of factors such as the style of knot, material of tie, length of tie, thickness of torso, etc., are changed, the device must be reset.

Each of the devices above is also subject to the deficiencies noted above for the category of that type of device.

OBJECTS AND ADVANTAGES

Accordingly, the present invention provides a tie tying device with the following objects and advantages:

(a) It requires no experimentation. It works the first time the tie is tied for various kinds of knots, degrees of tightness in the knot, tie lengths, tie thicknesses, desired hanging tie lengths, neck sizes, torso lengths, and torso girths.

(b) It provides a consistent result upon re-tying-there is a precise point where the wide end of the tie crosses the narrow end of the tie.

(c) It provides a quick and easy way to tie a tie.

(d) It does not require any specially manufactured ties.

(e) It does not require any cumbersome rack type device.

(f) It does not require any neck size measurements.

(g) It does not require any tie markers.

(h) It does not require any device that needs calibration.

(i) It does not require any belt to be worn or pants to have belt loops.

In addition:

(j) It may easily be adapted for use by the blind or visually handicapped or by sighted persons in the dark-the lines may be molded in relief or labeled in Braille.

(k) It works without modification even if the wearer gains or loses weight or grows in height.

Further objects and advantages of my invention will become apparent from a consideration of the drawings and ensuing description.

DRAWING FIGURES

FIG. 1(*a*) is a front view of a first side of a tie tying device, or gauge, in accordance with the invention, showing the placement of markings appropriate for all knots, using a normal cinch.

FIG. 1(*b*) is a front view of a second side of the device, showing the placement of markings appropriate for all knots, using a tight cinch.

FIGS. 2(*a*), 2(*b*), and 2(*c*) are, respectively, front views of the device as adapted to four-in-hand, half-Windsor, and Windsor knots, all with a normal cinch.

FIGS. 3(*a*), 3(*b*), and 3(*c*) are, respectively, front views of the device as adapted to four-in-hand, half-Windsor, and Windsor knots, all with a normal cinch, and with no knot length markings. The total length of the gauge is the length of the tie knot.

FIG. 4(*a*) and 4(*b*) are respectively, front and back view of the gauge as adapted for a shortened gauge that requires applying the gauge twice for a Windsor knot.

REFERENCE NUMERALS IN DRAWINGS

Figure 1A:
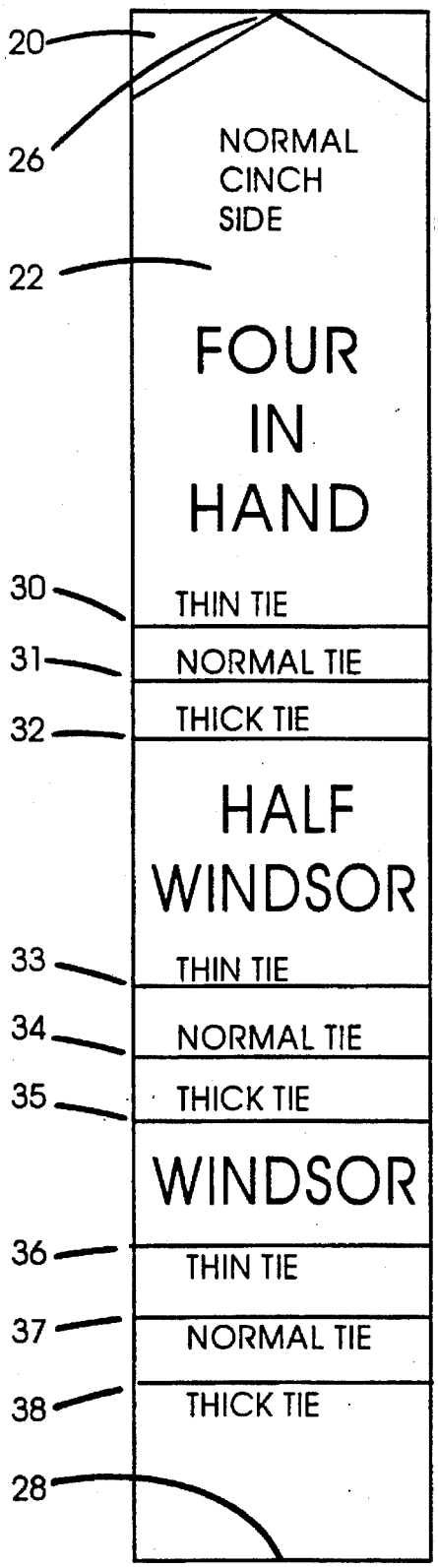

FIGS. 1–4:

20 gauge

22 front side of gauge

24 back side of gauge

26 V-marked end of gauge

28 non V-marked end of gauge

30 marking for four-in-hand knot, thin thickness tie, and normal cinch

31 marking for four-in-hand knot, normal thickness tie, and normal cinch

32 marking for four-in-hand knot, thick thickness tie, and normal cinch

33 marking for half-Windsor knot, thin thickness tie, and normal cinch

34 marking for half-Windsor knot, normal thickness tie, and normal cinch

35 marking for half-Windsor knot, thick thickness tie, and normal cinch

36 marking for Windsor knot, thin thickness tie, and normal cinch

37 marking for Windsor knot, normal thickness tie, and normal cinch

38 marking for Windsor knot, thick thickness tie, and normal cinch

40 marking for four-in-hand knot, thin thickness tie, and tight cinch

41 marking for four-in-hand knot, normal thickness tie, and tight cinch

42 marking for four-in-hand knot, thick thickness tie, and tight cinch

43 marking for half-Windsor knot, thin thickness tie, and tight cinch

44 marking for half-Windsor knot, normal thickness tie, and tight cinch

45 marking for half-Windsor knot, thick thickness tie, and tight cinch

46 marking for Windsor knot, thin thickness tie, and tight cinch

47 marking for Windsor knot, normal thickness tie, and tight cinch

48 marking for Windsor knot, thick thickness tie, and tight cinch

50 marking for "Add for Windsor" line

FIGS. 5–19:

80 tie

82 wide end of tie

84 narrow end of tie

85 end of wide end of tie

86 initial pinch point

87 collar button

88 desired end point for wide end of tie

90 final pinch point

92 tie knot

94 intermediate pinch point

SUMMARY

In accordance with the present invention, I provide a gauge, or tie knot measuring device, comprising a elongated member having a first end and a second end. The gauge contains indicia. The distance between the indicia is equal to the length of tie material that is contained in the knot of a knotted tie. The gauge provides the length of tie material contained in the three tie knots commonly used today: four-in-hand, half-Windsor, and Windsor. The gauge also takes into account whether the tie material is thin, medium, or thick, and whether the tie cinch (degree of tightness in the knot) is medium or tight.

The distance from the wearer's collar button to the desired end point for the wide end of the tie is the length of tie the wearer desires to hang down from the knot upon completion of tying. If this length were now crossed over the narrow end of the tie and a knot tied, the tie would be short by the length of tie that the knot takes. Therefore, to preserve the desired length, the gauge is used to add in the length of the tie knot. Then upon tying the tie, the desired length will be obtained.

Figure 1B:
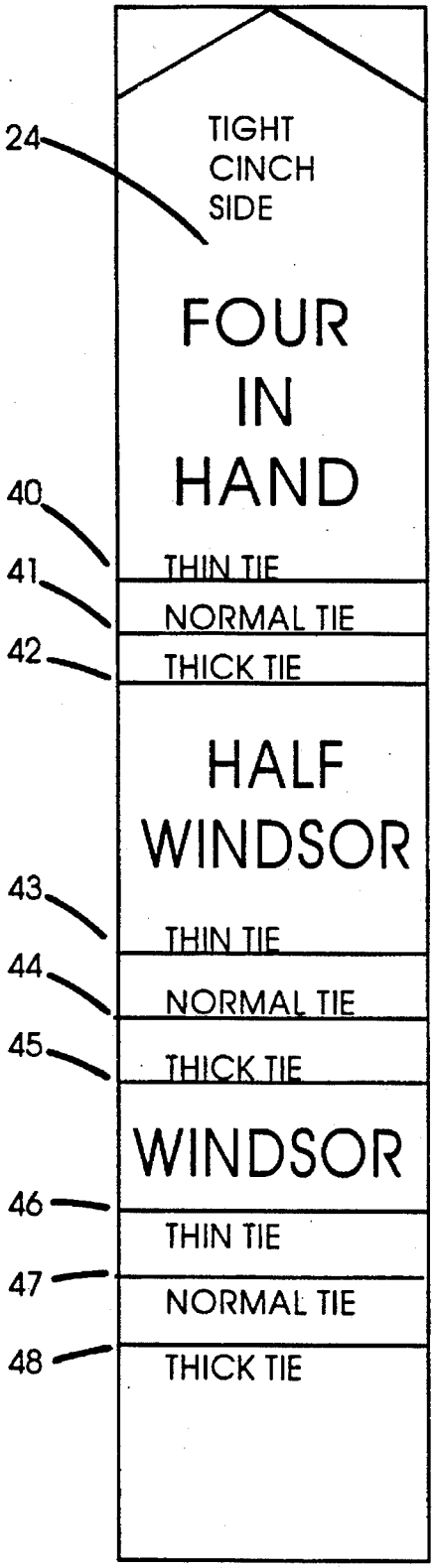

DESCRIPTION—FIGS. 1(*a*) AND 1(*b*)—BASIC GAUGE

FIGS. 1(*a*) and 1(*b*) show front views of first and second sides of a gauge 20 in accordance with a basic embodiment of the invention. Gauge 20 comprises a front, first surface 22 (FIG. 1(*a*)) and a back, second surface 24 (FIG. 1(*b*)). Gauge 20 is preferably made of thin plastic, is 36.8 centimeters (14.5 inches) long, and 6.4 centimeters (2.5 inches) wide. The gauge is rectangular in shape. A silk-screening process is used to place markings upon the gauge. One end of the gauge has a V-shaped marking 26 which represents the wide end of a tie. This marking indicates to the wearer that V-marked end of gauge 26 should be pointed downward when using gauge 20, just as the wide end of a tie is pointed downward when worn. The gauge also contains markings for various kinds of knots, thicknesses of tie, and tightness of cinch of knot. The length of the gauge is 2.5 centimeters (one inch) longer than the length of the longest tie knot marking on the gauge.

Gauge 20 contains markings for the three tie knots commonly used today: four-in-hand, half-Windsor, and Windsor. These knots can be distinguished by the number of times the wide end of the tie is brought upward while forming the knot: one time for a four-in-hand knot; two times for a half-Windsor knot; and three times for a full Windsor knot.

First surface 22 (FIG. 1(*a*)) contains markings for a normal cinched knot, for combinations of three tie material thicknesses, thin, normal, and thick, and the three types of tie knots. The markings are as follows:

(a) Four-in-hand knot, thin material tie, and normal cinch 30

(b) Four-in-hand knot, normal material tie, and normal cinch 31

(c) Four-in-hand knot, thick material tie, and normal cinch 32

(d) Half-Windsor knot, thin material tie, and normal cinch 33

(e) Half-Windsor knot, normal material tie, and normal cinch 34

(f) Half-Windsor knot, thick material tie, and normal cinch 35

(g) Windsor knot, thin material tie, and normal cinch 36

(h) Windsor knot, normal material tie, and normal cinch 37

(i) Windsor knot, thick material tie, and normal cinch 38

Second surface 24 (FIG. 1(*b*)) contains markings for a tightly cinched knot, for combinations of three tie material thicknesses, thin, normal, and thick, and the three types of tie knots. The markings are as follows:

(a) Four-in-hand knot, thin material tie, and tight cinch 40

(b) Four-in-hand knot, normal material tie, and tight cinch 41

(c) Four-in-hand knot, thick material tie, and tight cinch 42

(d) Half-Windsor knot, thin material tie, and tight cinch 43

(e) Half-Windsor knot, normal material tie, and tight cinch 44

(f) Half-Windsor knot, thick material tie, and tight cinch 45

(g) Windsor knot, thin material tie, and tight cinch 46

(h) Windsor knot, normal material tie, and tight cinch 47

(i) Windsor knot, thick material tie, and tight cinch 48

OPERATION AND USE—FIGS. 1(*a*) AND 1(*b*)—BASIC GAUGE

FIGS. 5–15 demonstrate the use of the gauge. The wearer drapes a tie 80 (FIG. 5) around the wearer's neck such that a wide end of tie 82 is on the wearer's right side, and a narrow end of tie 84 is on the wearer's left side.

The wearer then pinches wide end of tie 82 (FIG. 6) with the right fore-finger and thumb and touches this initial pinch point 86 to the wearer's collar button 87, such that an end of wide end of tie 85 is touching a wearer's desired end point for wide end of tie 88 after the tie has been tied.

While maintaining initial pinch point 86 on the tie (FIG. 7), the wearer slides the tie down the right side of the wearer's body until initial pinch point 86 is 2.5 or 5 centimeters (an inch or two) above the beltline. This exact location is not important. The purpose of this step is just to give the wearer ample room to perform the following steps.

While maintaining initial pinch point 86 with the right hand (FIG. 8), the wearer grasps tie gauge 20 with the left hand and places it lengthwise on top of the tie and against the wearer's body such that V-marked end of gauge 26 is adjacent initial pinch point 86. The wearer then creates a final pinch point 90 (FIG. 9) on the tie adjacent the appropriate mark on tie gauge 20.

While maintaining final pinch point 90 (FIG. 10), the wearer removes tie gauge 20 from the tie—it is not needed anymore.

The wearer then crosses wide end of tie 82 (FIG. 11) over narrow end of tie 84 such that final pinch point 90 on wide end of tie 82 is directly on top of narrow end of tie 84 somewhere near the end of narrow end of tie 84. The point on the narrow end that is being crossed is not important—the tie tying result will be the same.

Figure 12:
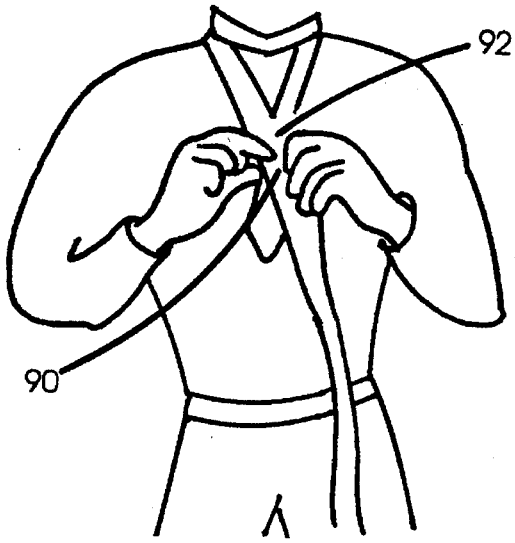
Figure 13:
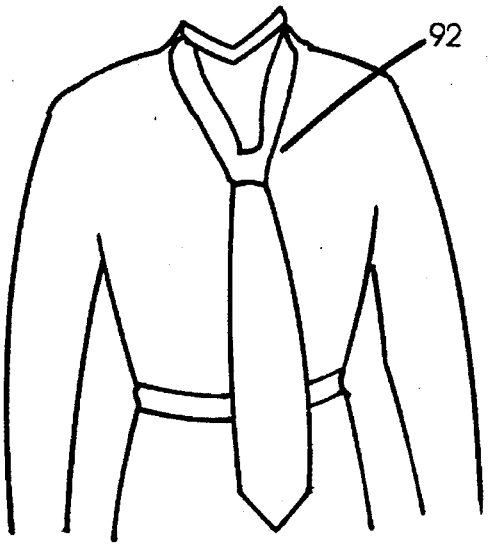
Figure 14:
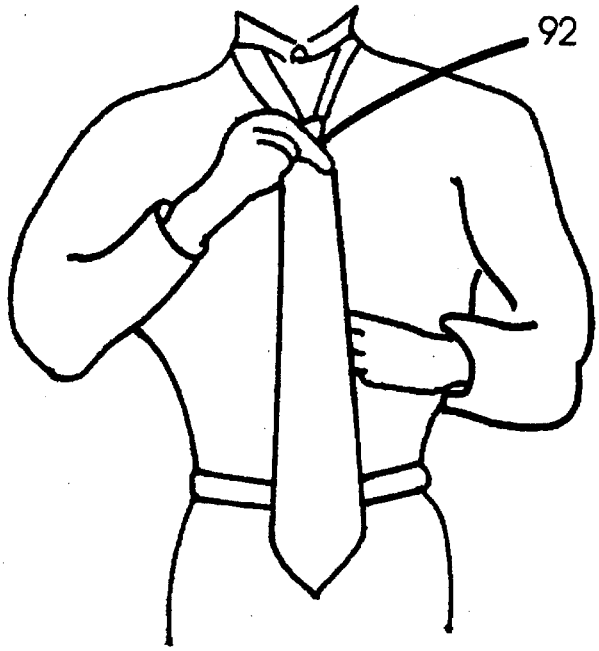
Figure 15:
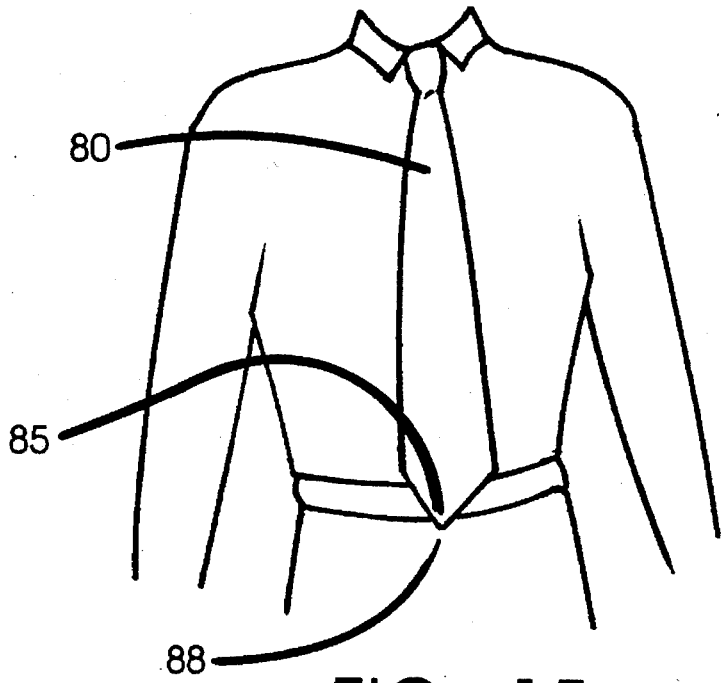
Figure 16:
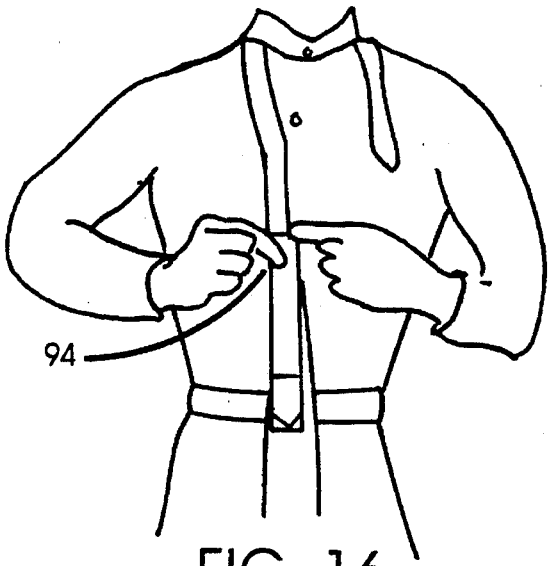
FIGS. 16–19 show front views of illustrating the process by which the gauge is applied twice to tie a Windsor knot.

The wearer then ties a desired knot 92 at final pinch point 90. (FIGS. 12, 13). Knot 92 is then slipped up the tie to the neckline (FIG. 14) and the tie is now properly tied (FIG. 15), with the tip of the wide end of tie 85 touching desired end point for wide end of tie 88.

The appropriate knot lengths in centimeters—with the inches equivalent shown in parenthesis—are as set forth in the following Table 1:

| | Thin tie | Normal Tie | Thick Tie |
|---|---|---|---|
| Normal Cinch | | | |
| four-in-hand | 14.0 (5.50) | 15.2 (6.00) | 16.5 (6.50) |
| half-Windsor | 22.9 (9.00) | 24.8 (9.75) | 26.7 (10.50) |
| Windsor | 29.2 (11.50) | 31.8 (12.50) | 34.3 (13.50) |
| Tight cinch | | | |
| four-in-hand | 12.7 (5.00) | 14.0 (5.50) | 15.2 (6.00) |
| half-Windsor | 21.6 (8.50) | 23.5 (9.25) | 25.4 (10.00) |
| Windsor | 27.9 (11.00) | 30.5 (12.00) | 33.0 (13.00) |

The wearer's desired tie length measurement (FIG. 6)—the length from the collar button 87 to the desired end point for the wide end of the tie 88—takes into account all physical variations among wearers (varying torso lengths and varying torso girths), as well as all variations in wearer preferences for wearing the wide end of their ties. This allows every gauge to have consistent tie knot length markings regardless of the wearer's physical build or tie wearing preference.

The wearer's desired tie length measurement (FIG. 6) is not to be confused with any method which aligns a marked point on the tie to the collar button or Adam's apple to simply hang the tie about the wearer's neck in a consistent fashion prior to the tie being tied. Also it should not be confused with any method which aligns the wide end of the tie at a certain point to simply hang the tie about the wearer's neck in a consistent fashion prior to the tie being tied.

Figure 2A:
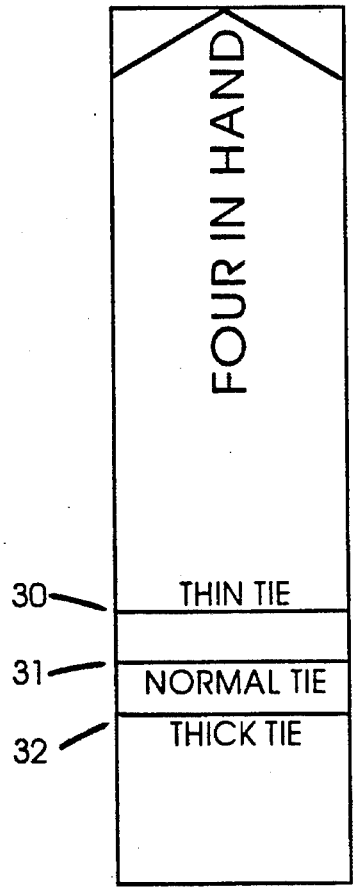
Figure 2B:
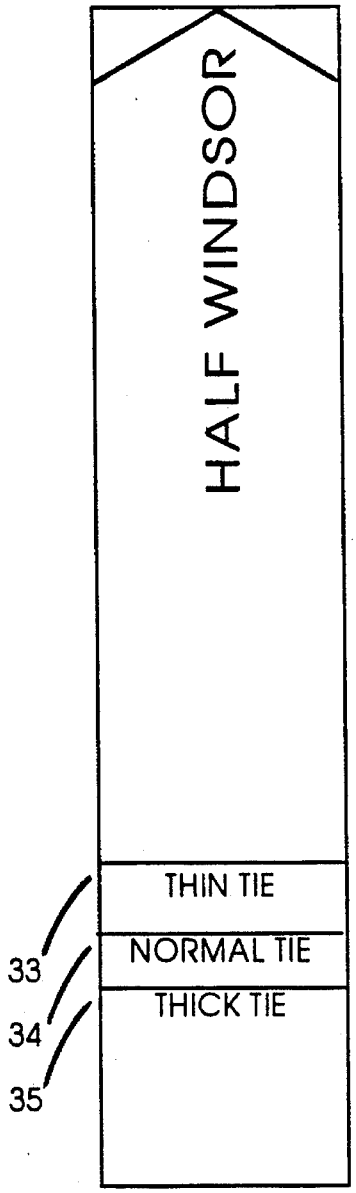
Figure 2C:
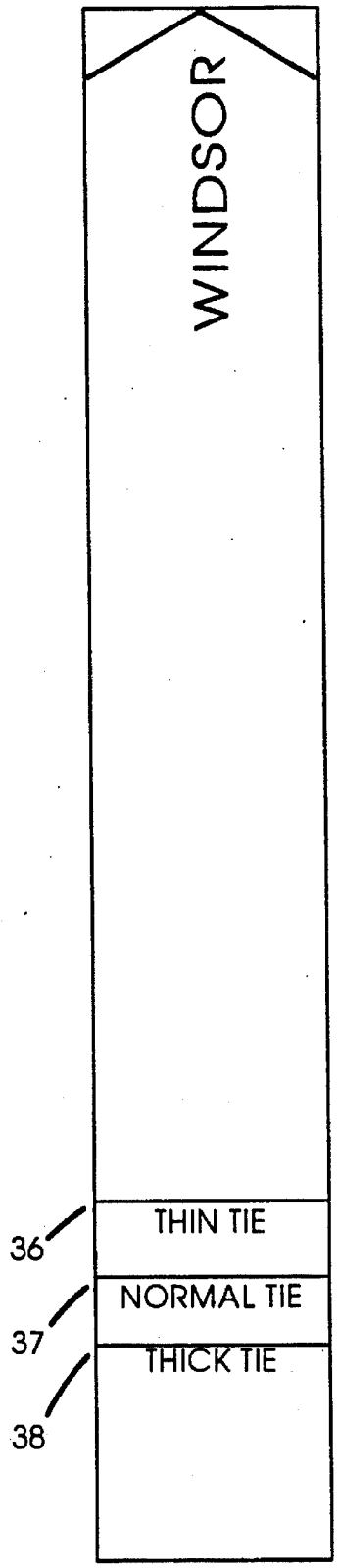

DESCRIPTION—FIGS. 2(*a*) TO 2(*c*)—SEPARATE GAUGES FOR DIFFERENT KINDS OF KNOTS

FIGS. 2(*a*), 2(*b*), and 2(*c*) are, respectively, front views of the gauge as adapted to four-in-hand, half-Windsor, and Windsor knots, all with a normal cinch. These gauges are, respectively, 19.1 centimeters (7.5 inches)long, 29.2 centimeters (11.5 inches) long, and 36.8 centimeters (14.5 inches) long. Each on these gauges is 2.5 centimeters (1 inch) longer than the length of the longest tie knot marking on the gauge. Gauge 2(*a*) has markings for the following tie knots and tie thicknesses: a four-in-hand knot and thin tie 30, a four-in-hand knot and normal tie 31, and a four-in-hand knot and thick tie 32. Gauge 2(*b*) has markings for the following tie knots and tie thicknesses: a half-Windsor knot and thin tie 33, a half-Windsor knot and normal tie 34, and a half-Windsor knot and thick tie 35. Gauge 2(*c*) has markings for the following tie knots and tie thicknesses: a Windsor knot and thin tie 36, a Windsor knot and normal tie 37, and a Windsor knot and thick tie 38. Note that the marks on gauges 2(*a*), 2(*b*), and 2(*c*) do correspond to the same markings on the gauge of FIG. 1(*a*). The marks have simply been placed on three gauges instead of one. These gauges are used in the same manner as the gauge of FIGS. 1(*a*) and 1(*b*).

Figure 3A:
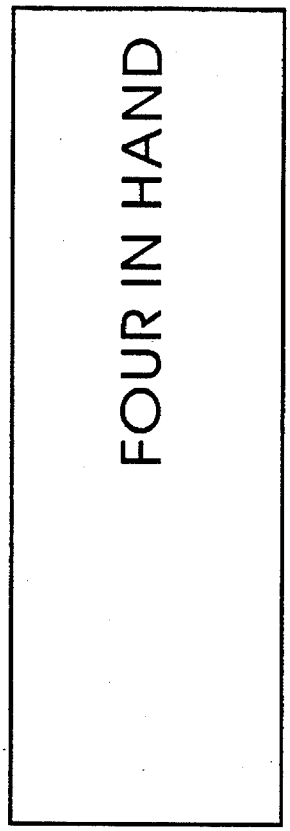
Figure 3B:
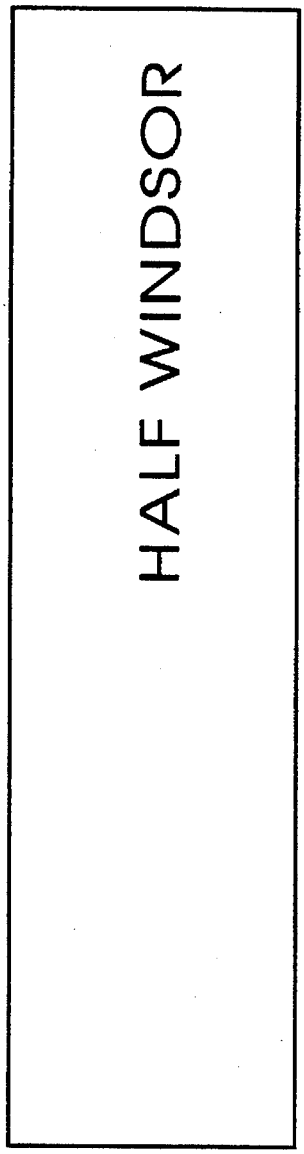
Figure 3C:
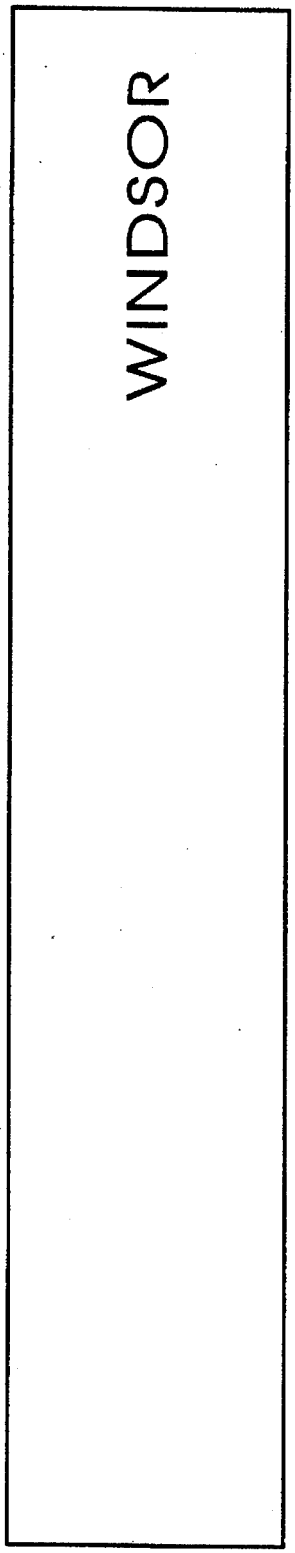

DESCRIPTION—FIGS. 3(*a*) TO 3(*c*)—GAUGES WITH NO KNOW LENGTH MARKINGS

FIGS. 3(*a*), 3(*b*), and 3(*c*) are, respectively, front views of the gauge as adapted to four-in-hand, half-Windsor, and Windsor knots, all with a normal cinch and tie thickness, and all with no knot length markings. These gauges have no V-marked end 26 because they work the same regardless of which end is up. These gauges are, respectively, 15.2 centimeters (6.0 inches) long, 24.8 centimeters (9.75 inches) long, and 31.8 centimeters (12.5 inches) long. The length of each gauge is the length of the tie knot for that gauge. The total length of gauge 3(*a*) is the length of tie material in a four-in-hand knot; the total length of gauge 3(*b*) is the length of tie material in a half-Windsor knot; and the total length of gauge 3(*c*) is the length of tie material in a full Windsor knot. These gauges are used in the same manner as the gauge of FIGS. 1(*a*) and 1(*b*), except that final pinch point (90) is created adjacent the non V-marked end of the gauge 28, as opposed to a marking on the gauge.

Figure 4A:
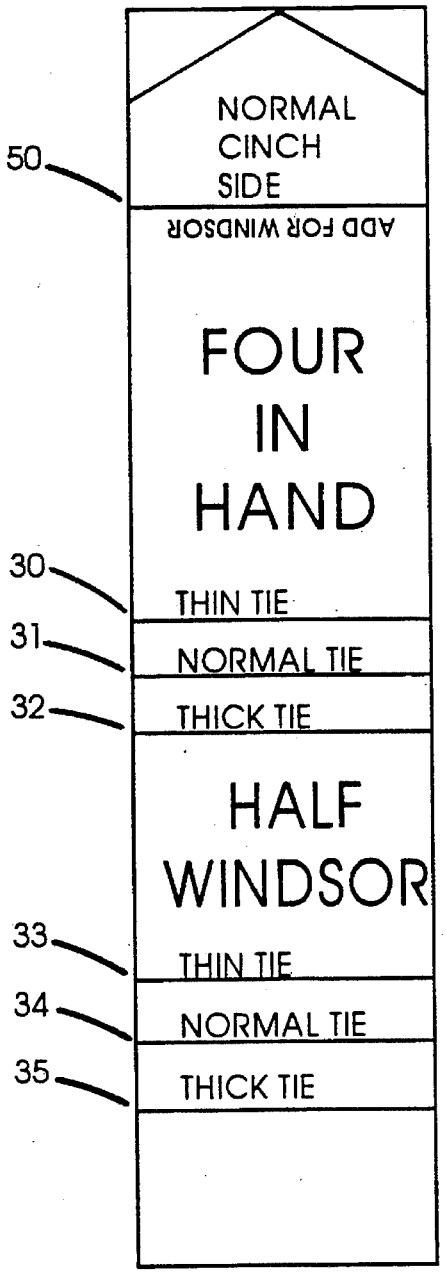
Figure 4B:
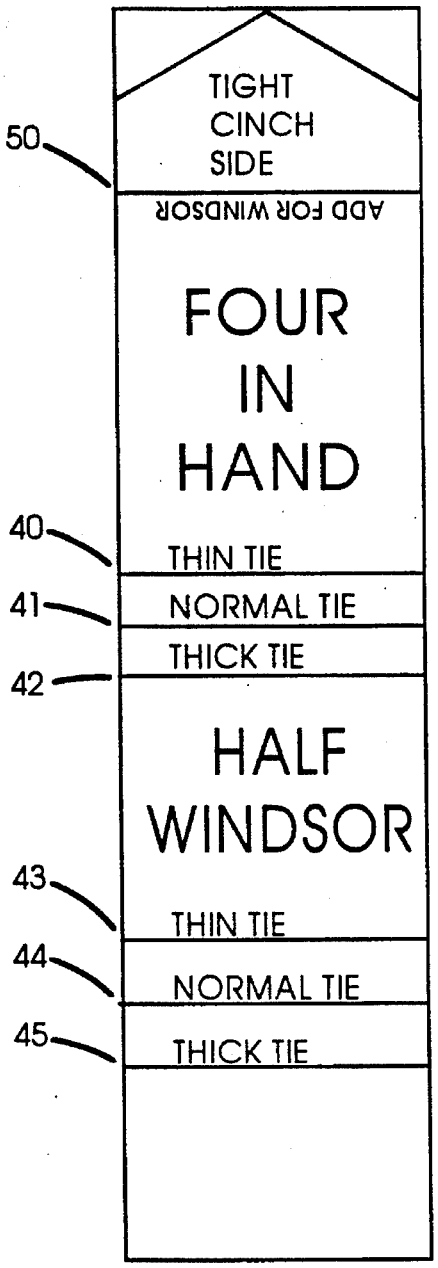
Figure 5:
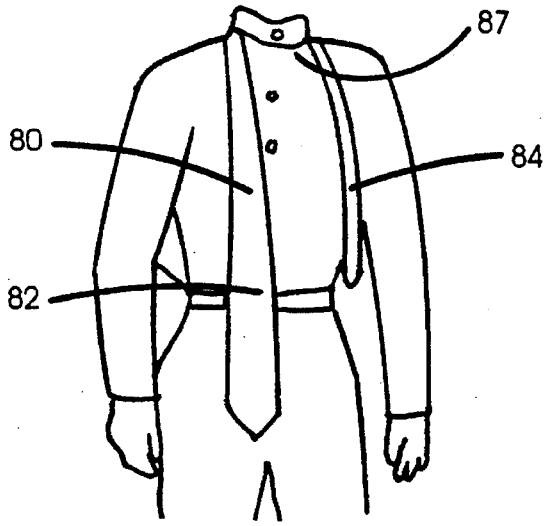
FIGS. 5–15 show front views of illustrating the process by which the gauge may be used to tie a tie to the wearer's desired length.
Figure 6:
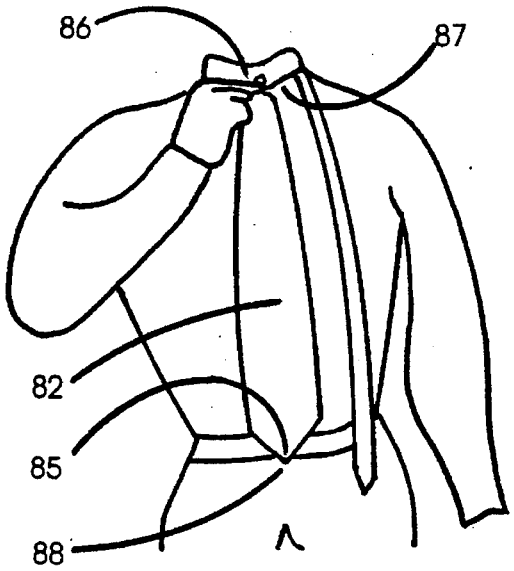
Figure 7:
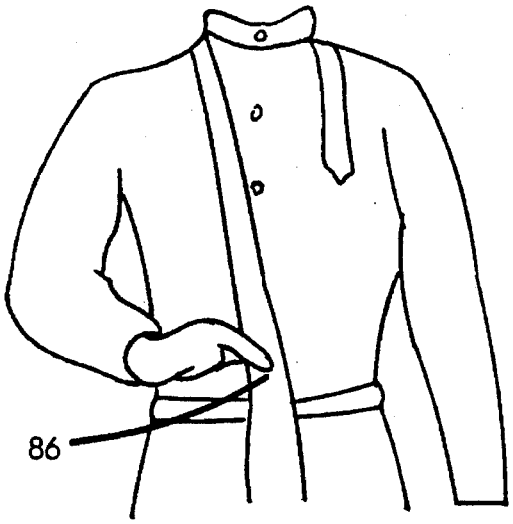
Figure 8:
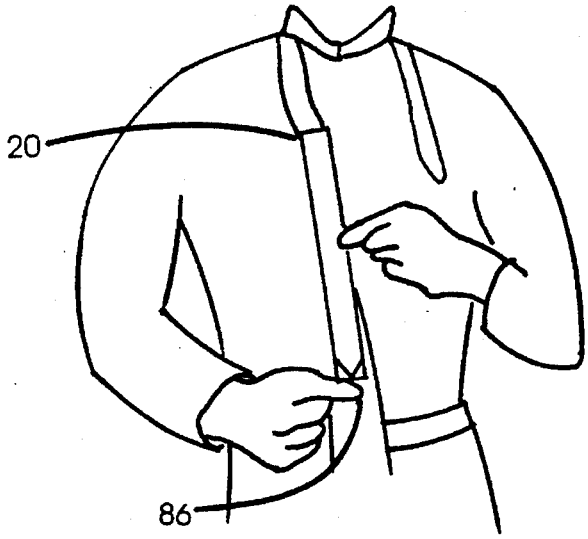
Figure 9:
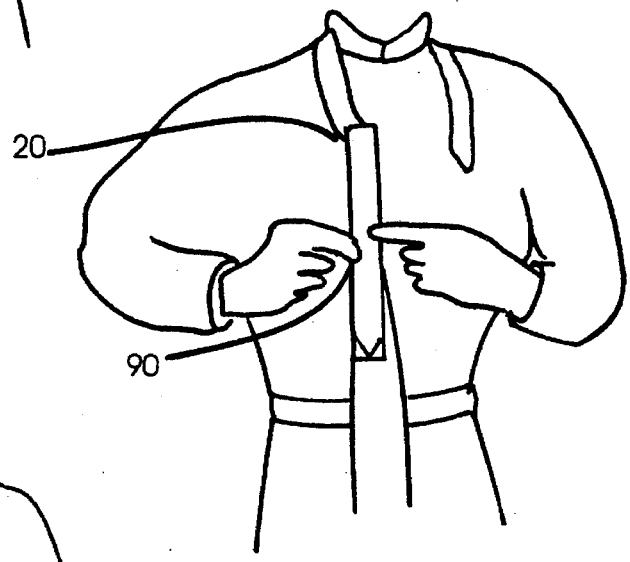
Figure 10:
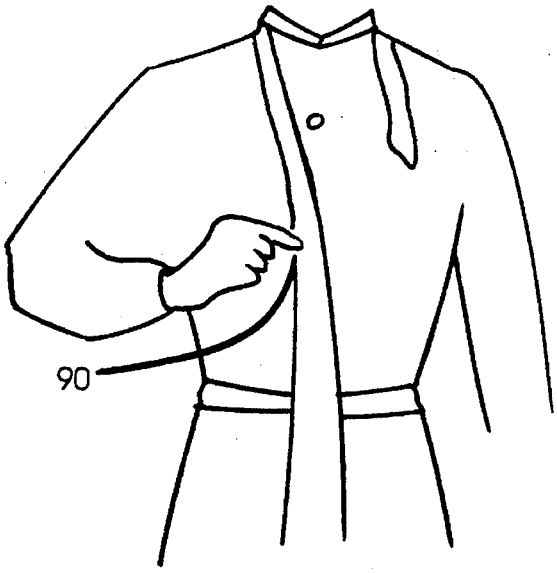
Figure 11:
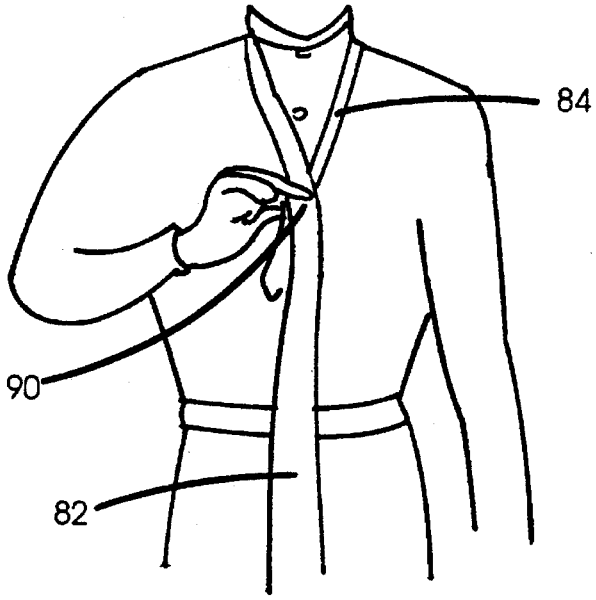

DESCRIPTION—FIGS. 4(*a*) AND 4(*b*)—SHORTENED GAUGE THAT IS APPLIED TWICE WHEN TYING A WINDSOR KNOT

FIGS. 4(*a*) and 4(*b*) are respectively, front and back views of the gauge as adapted for a shortened gauge that is applied twice when tying a Windsor knot. A shortened gauge has the advantage of being smaller and easier to wield. This gauge is 29.2 centimeters (11.5 inches) long—2.5 centimeters (one inch) longer than the longest half-Windsor knot marking on the gauge. This gauge has the same knot length markings as the basic gauge of FIGS. 1(*a*) and 1(*b*) for four-in hand and half-Windsor knots. However, for Windsor knots this gauge and the basic gauge differ. This gauge has a single Windsor knot marking 50 that is 7.0 centimeters (2.75 inches) from the V-marked end of the gauge 26—7.0 centimeters (2.75 inches) is the arithmetic difference between the knot length of a Windsor knot and the knot length of a half-Windsor knot.

OPERATION AND USE—FIGS. 4(*a*) AND 4(*b*)—SHORTENED GAUGE THAT IS APPLIED TWICE WHEN TYING A WINDSOR KNOT

Figure 17:
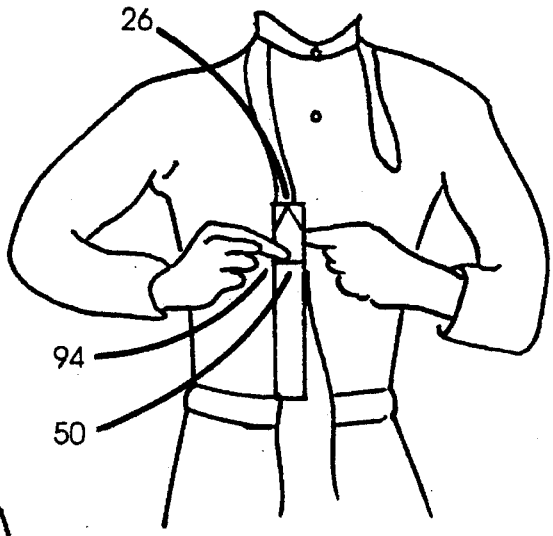
Figure 18:
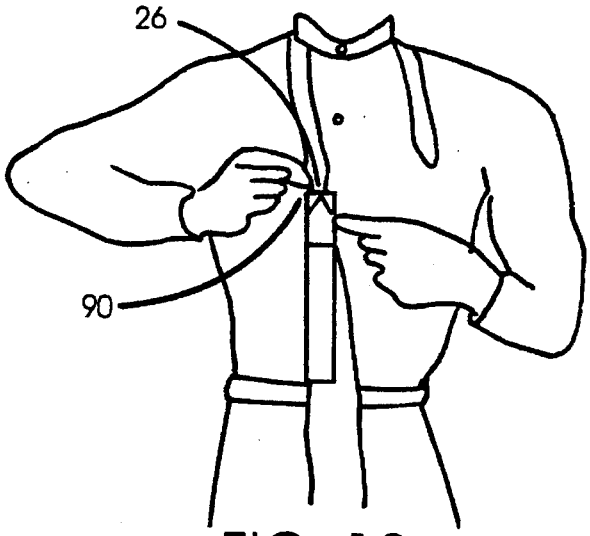
Figure 19:
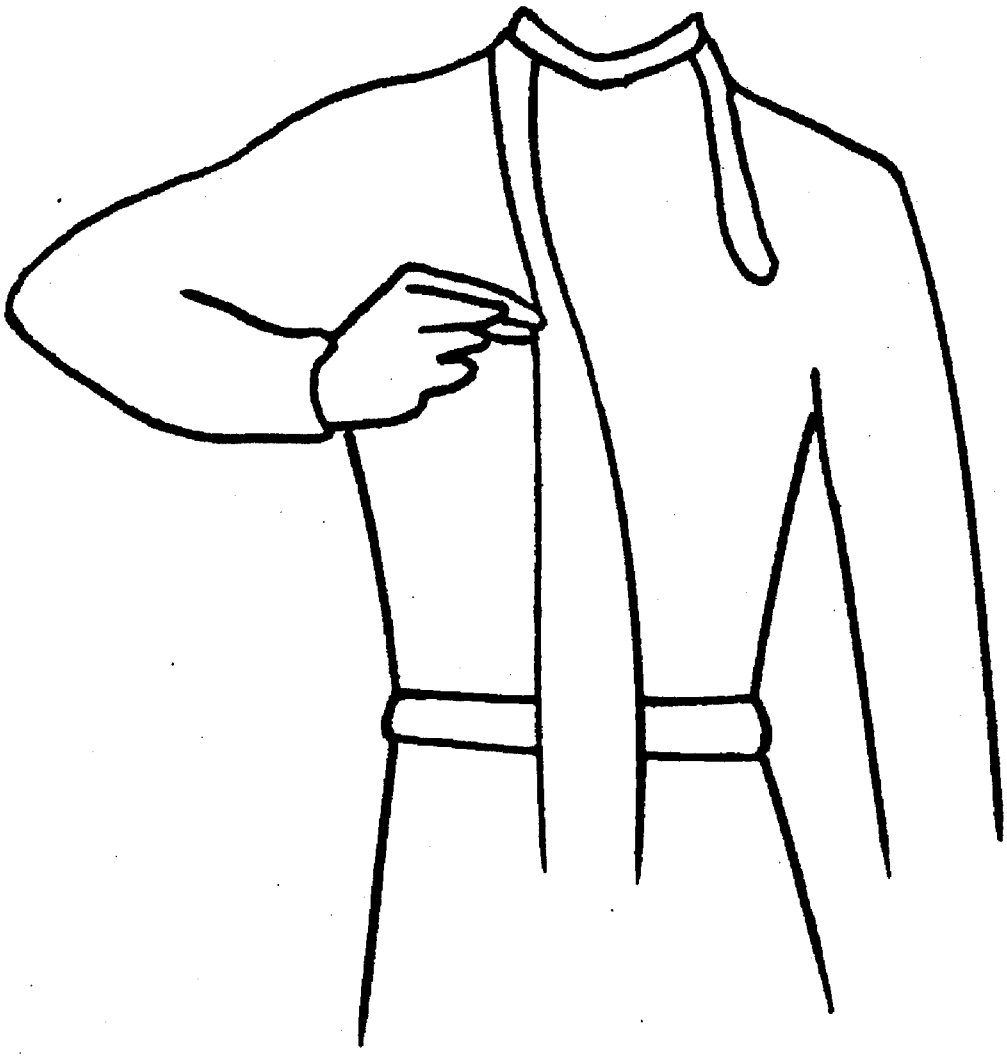

This gauge is used in the same manner as the gauge of FIGS. 1(*a*) and 1(*b*) for four-in-hand and half-Windsor knots. However, the operation of this gauge is different from that of the basic gauge of FIGS. 1(*a*) and 1(*b*) when tying a Windsor knot. FIGS. 16–19 demonstrate how to tie a Windsor knot with this gauge. The user creates an intermediate pinch point 94 (FIG. 16) adjacent the half-Windsor mark on the gauge. While maintaining the intermediate pinch point 94 (FIG. 17), the user turns the gauge from top to bottom such that the V-marked end of gauge 26 (FIG. 17) is pointed upward, and "Add for Windsor" line 50 (FIG. 17) is adjacent the intermediate pinch point 94 (FIG. 17). The user then creates a final pinch point 90 (FIG. 18) adjacent the V-marked end of the gauge 26 (FIG. 18). Lastly the user removes the gauge (FIG. 19) and the tie is ready to be tied.

SUMMARY, RAMIFICATIONS, AND SCOPE

It can be seen that the gauge and method eliminates the experimentation process when tying a tie—the tie comes out to the desired length on the first tie. It works the first time regardless of kind of knot, degree of tightness in the knot, tie length, tie thickness, desired hanging tie length, neck size, torso length, and torso girth. It also provides a consistent result upon re-tying—there is a precise point where the wide end of the tie crosses over the narrow end of the tie. In addition it is simple and easy to use. It also may be modified to many uses, such as having raised lettering or Braille for the sight impaired.

Although the present invention has been described in terms of the presently preferred embodiment, such description should not be interpreted as limiting. Various alterations and modifications will no doubt become apparent to those skilled in the art after having read the above disclosure. E.g., the gauge may be made of other materials: plastic, paper, cardboard, wood, metal, etc. The gauge may have other shapes: rectangular, shaped like a tie, rectangular with a tie painted on it, a hook on one end to hang up when not in use, a hole in one end to hang up when not in use. The pinch point indicators may be raised lines (intaglio), engraved lines, dots, holes instead of lines, etc. The lettering on the device may be raised or engraved. The device, the pinch point indicators on the device, and the lettering may be of other colors. The backside of the device may be used for instructions on how to use the device. The device may be modified to make transport easier: foldable versions that make the device smaller, slide rule type versions that make the device smaller. A tie with an extra slick surface or an extra rough surface may affect the measurements slightly. Many combinations of markings on other gauges can be provided to accommodate individual needs.

Accordingly, it is intended that the appended claims and their legal equivalents be interpreted as covering all alterations and modifications as fall within the true spirit and scope of the invention.

I claim:

1. A tie tying device for aiding a user in knotting a tie so that one end hangs to a desired length and has a knot having a predetermined length, comprising: a gauge comprising an elongated member having front and rear surfaces and top and bottom opposite ends, said elongated member containing an indicium thereon, the distance between said indicium and another predetermined part of said elongated member having a predetermined value equal to the length of tie material required to tie said knot.

2. The device of claim 1 wherein said knot is selected from the class consisting of four-in-hand, half-Windsor, and Windsor knots and said distance between said indicium and said predetermined part is equal to the length of said knot.

3. The device of claim 1 wherein said indicium is said top end of said elongated member.

4. The device of claim 1 wherein said indicium is a line upon said front surface of said elongated member.

5. The device of claim 1 wherein said predetermined part is said bottom end of said elongated member.

6. The device of claim 1 wherein said predetermined part is said top end of said elongated member.

7. The device of claim 1 wherein said predetermined part is a line.

8. The device of claim 1 wherein said predetermined part and said indicium are lines.

9. The device of claim 1, further including a second indicium, each of said indicia being labeled for a different kind of knot.

10. The device of claim 1, further including a second indicium, each of said indicia being labeled for a different thickness of tie material.

11. The device of claim 1, further including a second indicium, each of said indicia being labeled for a different tightness knot.

12. A method for tying a necktie, comprising:

providing an elongated gauge having a first end and a second, opposite end and first and second indicia thereon, said indicia having a predetermined spacing there between, draping a necktie around a wearer's neck such that a wide end of said tie is on one side of said wearer's neck and a narrow end of said tie is on another side of said wearer's neck, pinching said wide end of said tie at a location on said tie such that, when said wearer locates said initial pinch point adjacent a wearer's collar button, said wide end of said tie is adjacent a wearer's desired end point for said wide end of said tie after said tie has been tied, while maintaining said initial pinch point, sliding said wide end of said tie down said wearer's body until said initial pinch point is just above a beltline of said wearer, grasping said gauge, and placing said gauge lengthwise on top of said tie and against said wearer's body such that said first indicium of said gauge is adjacent said initial pinch point, with said hand that is currently maintaining said initial pinch point, creating a final pinch point on said tie next to said second indicium on said gauge, removing said gauge from said tie, crossing said wide end of said tie over said narrow end of said tie such that said final pinch point on said wide end of said tie is directly on top of said narrow end of said tie, and tying a knot and slipping said knot to a neckline.

13. The method of claim 12 wherein said predetermined distance between said first and second indicia of said gauge is equal to the length of a predetermined knot.

14. The method of claim 13 wherein said knot is a four-in-hand knot.

15. The method of claim 13 wherein said knot is a half-Windsor knot.

16. The method of claim 13 wherein said knot is a Windsor knot.

17. A method for tying a necktie, comprising:

providing an elongated gauge having a first end and a second, opposite end and first, second, third, and fourth indicia thereon, said first and second indicia having a predetermined spacing there between and said third and fourth indicia having a predetermined spacing there between, draping a necktie around a wearer's neck such that a wide end of said tie is on one side of said wearer's neck and a narrow end of said tie is on another side of said wearer's neck, pinching said wide end of said tie at a location on said tie such that, when said wearer locates said initial pinch point adjacent a wearer's collar button, said wide end of said tie is adjacent a wearer's desired end point for said wide end of said tie after said tie has been tied, while maintaining said initial pinch point, sliding said wide end of said tie down said wearer's body until said initial pinch point is just above a beltline of said wearer, grasping said gauge, and placing said gauge lengthwise on top of said tie and against said wearer's body such that said first indicium of said gauge is adjacent said initial pinch point, with said hand that is currently maintaining said initial pinch point, creating an intermediate pinch point on said tie next to said second indicium on said gauge, placing said gauge lengthwise on top of said tie and against said wearer's body such that said third indicium of said gauge is adjacent said intermediate pinch point, with said hand that is currently maintaining said intermediate pinch point, creating a final pinch point on said tie adjacent said fourth indicia on said gauge, removing said gauge from said tie, crossing said wide end of said tie over said narrow end of said tie such that said final pinch point on said wide end of said tie is directly on top of said narrow end of said tie, and tying a knot and slipping said knot to a neckline.

18. The method of claim 17 wherein said predetermined distance between said first and second indicia of said gauge added to said predetermined distance between said third and fourth indicia of said gauge has a predetermined length corresponding to a predetermined knot.

19. The method of claim 18 wherein said knot is a four-in-hand knot.

20. The method of claim 18 wherein said knot is a half-Windsor knot.

21. The method of claim 18 wherein said knot is a Windsor knot.

* * * * *